US006434252B1

(12) United States Patent
Royer et al.

(10) Patent No.: US 6,434,252 B1
(45) Date of Patent: Aug. 13, 2002

(54) RIBBON MICROPHONE

(75) Inventors: David E. Royer, Fullerton; Richard T. Perrotta, Burbank, both of CA (US)

(73) Assignee: Royer Labs, Burbank, CA (US)

( * ) Notice: Subject to any disclaimer, the term of this patent is extended or adjusted under 35 U.S.C. 154(b) by 0 days.

(21) Appl. No.: 09/399,227

(22) Filed: Sep. 20, 1999

(51) Int. Cl.[7] ..... H04R 25/00
(52) U.S. Cl. ..... 381/399; 381/431; 381/176
(58) Field of Search ..... 381/176, 399, 381/412, 431, 396, 115, 111

(56) References Cited

U.S. PATENT DOCUMENTS

| | | | | | |
|---|---|---|---|---|---|
| 2,173,219 | A | * | 9/1939 | Anderson | 381/115 |
| 2,495,809 | A | * | 10/1950 | Graham | 381/115 |
| 2,699,474 | A | * | 1/1955 | Olson et al. | 381/115 |
| 2,963,557 | A | * | 12/1960 | Anderson | 381/115 |
| 3,435,143 | A | * | 3/1969 | Fisher | 381/115 |
| 3,564,163 | A | * | 2/1971 | Hobrough | 381/176 |
| 4,049,926 | A | * | 9/1977 | Kasatkin et al. | 381/176 |
| 4,072,821 | A | * | 2/1978 | Bauer | |
| 4,150,423 | A | * | 4/1979 | Boschert | 363/25 |
| 4,258,467 | A | * | 3/1981 | Witte | 29/605 |
| 4,317,966 | A | * | 3/1982 | Lister | 381/176 |
| 4,319,096 | A | * | 3/1982 | Winey | |
| 4,320,373 | A | * | 3/1982 | Witte | 336/183 |
| 4,473,723 | A | * | 9/1984 | Hobrough | 381/176 |
| 4,580,014 | A | * | 4/1986 | Hobrough | 381/176 |
| 5,195,143 | A | * | 3/1993 | Speigel et al. | 381/176 |
| 5,325,439 | A | * | 6/1994 | Smiley | 381/199 |
| 5,748,758 | A | * | 5/1998 | Menasco, Jr. et al. | 381/176 |
| 6,060,976 | A | * | 5/2000 | Yamaguchi et al. | 336/200 |

FOREIGN PATENT DOCUMENTS

| | | | | | |
|---|---|---|---|---|---|
| GB | 2081551 | A | * | 2/1982 | 381/176 |

* cited by examiner

*Primary Examiner*—Curtis Kuntz
*Assistant Examiner*—P. Dabney
(74) *Attorney, Agent, or Firm*—Evan M. Kent; Stewart L. Gitler

(57) ABSTRACT

A ribbon microphone having magnets positioned adjacent north and south pole pieces. The magnets are of uniform thickness along their lengths, and do not taper. The pole pieces are substantially the same width as the magnets. An offset ribbon is disposed in an air gap between the pole pieces. The offset ribbon is not centered in the air gap, but rather is offset from a center line which bisects the magnets and pole pieces. The offset ribbon is located closer to the front of the microphone than the back of the microphone. The flux area is uniform and corresponds to the area of the air gap between the pole pieces.

20 Claims, 5 Drawing Sheets

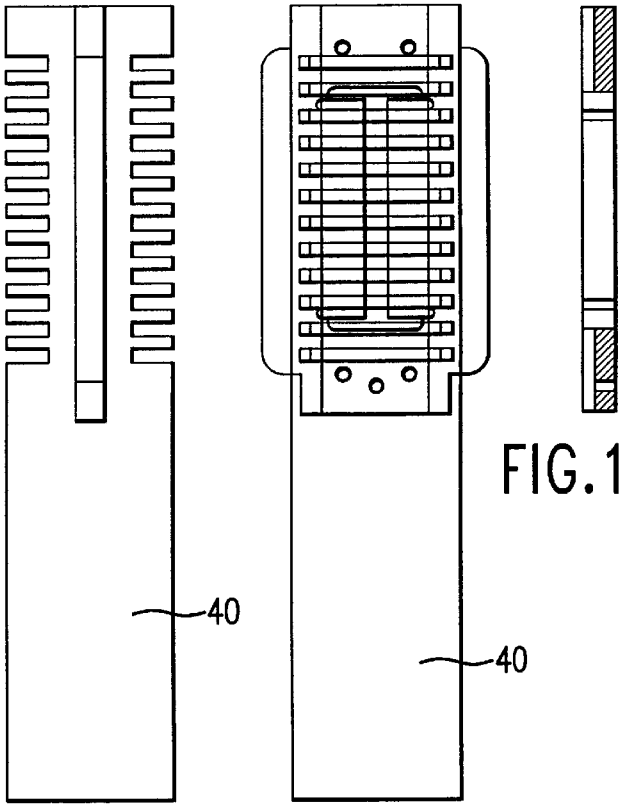
FIG.11A
FIG.11B
FIG.11C
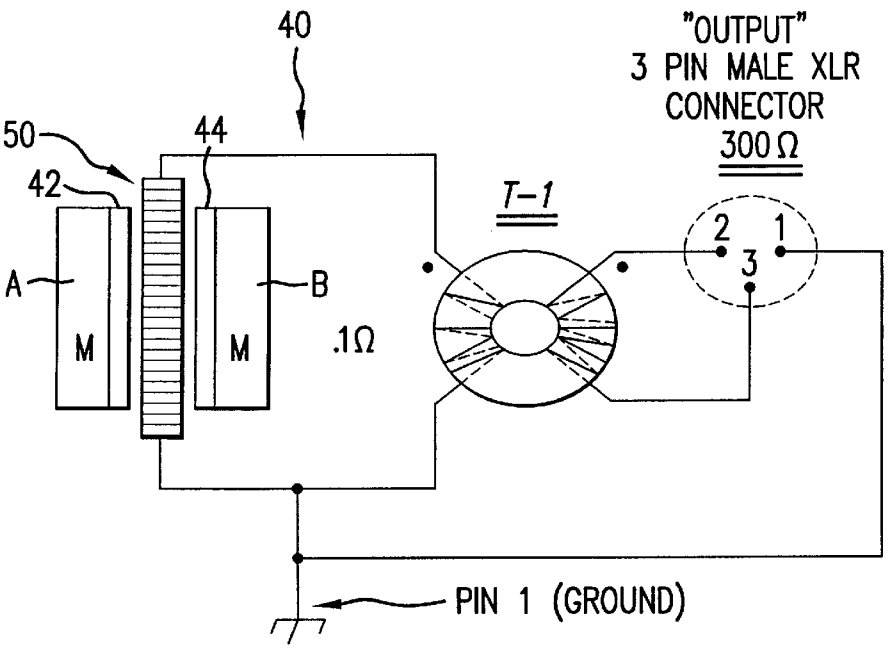
FIG.10

RIBBON MICROPHONE

BACKGROUND OF THE INVENTION

1. Field of the Invention

The present invention relates to a ribbon microphone. More particularly, the present invention relates to a ribbon microphone that produces absolutely realistic sound performance, free of coloration and distortion and that provides an electrical equivalent of the acoustic information so that digital converters can read the acoustic information very accurately in digital audio conversion.

2. Description of the Prior Art

Ribbon microphones have been around for many years, and reached their peak of popularity in the 1950's. Condenser microphones and dynamic microphones, which were smaller and more sensitive replaced the ribbon microphone. Ribbon microphone rely on tapered pole-pieces that concentrate a magnetic field to a narrow point, with a ribbon suspended exactly in the middle of that point, between an air gap. The tapered pole pieces were utilized to maximize the sensitivity of the microphones. Cobalt steel and later Alnico 5 and 7 were the best magnetic materials available to microphone designers in the 1930's. Because of the rather large pole pieces and the relatively weak magnets it was common to taper the pole pieces to provide a sufficiently strong field at the ribbon and thereby provide acceptable sensitivity. The foregoing was the accepted design for ribbon microphones.

Due to the shallow area in front of and behind the ribbon, where the magnetic flux was uniform, the motion of the ribbon was restricted, for example by damping screens. The restriction of motion of the ribbon was to minimize distortion. Furthermore, the assembly process required precise alignment of the ribbon in order to minimize the distortion. The ribbon had to be perfectly positioned to perform properly.

The ribbons themselves were very thin. As a result, a blast of air would often deform the ribbon to such an extent that the ribbon no longer was positioned in the gap, thus creating the undesired distortion. Although conventional ribbon microphones are sensitive at low and moderate levels, when very high pressure waves strike the ribbon microphone, the ribbon is pushed away from the narrow gap causing decreased efficiency. The early ribbon microphones were adequate for recording at the lower volume levels prevalent at that time, however, modern day recording environments involve high volume levels for which such ribbon microphones are inadequate.

A ribbon microphone consists of a strip of aluminum foil, of approximately one ten-thousandth of an inch thick, 3/16" wide and 1.5" long. The ribbon is suspended between the poles of a powerful magnet. Sound waves force the ribbon to vibrate in a direction perpendicular to its length, and as the ribbon moves an electrical voltage is induced in the ribbon. With most ribbon microphone designs the impedance of the ribbon is a small fraction of an ohm, so that a suitable transformer is connected between the ribbon and a following pre-amplifier, to step up the impedance to a value on the order of 250 ohms. The use of a transformer also provides a voltage step up on the order of 30 dB.

The most common types of microphones in use today are condenser microphones and dynamic microphones, primarily because they are more robust than conventional ribbon microphones, and because they are well suited to recording for television. However, such conventional condenser and dynamic microphones are poorly suited to burgeoning digital recording field. Digital conversion in audio recording needs to be as accurate as possible. Conventional microphones produce too many high-frequency dips and/or phase distortions, that incorrectly are interpreted as data in the digital recording process.

SUMMARY OF THE INVENTION

From the foregoing, it is an object of the present invention to provide a ribbon microphone that produces absolutely realistic sound performance, free from coloration and distortion.

Still another object of the present invention is to provide a ribbon microphone that is well suited to digital audio recording.

Another object of the present invention is to provide a ribbon microphone that requires no external power supply.

Yet another object of the present invention is to provide a ribbon microphone having a compact size.

Still another object of the present invention is to provide a ribbon microphone that is not affected by changes in temperature and/or humidity.

Another object of the present invention is to provide a ribbon microphone that is durable and easily repaired.

These and other deficiencies of the prior art are addressed by the present invention which is directed to a ribbon microphone. The ribbon microphone utilizes magnets positioned adjacent north and south pole pieces. The magnets are of uniform thickness along their lengths, and do not taper. The pole pieces are substantially the same width and the magnets. An offset ribbon is disposed in an air gap between the pole pieces. The offset ribbon is not centered in the air gap, but rather is offset front a center line which bisects the magnets and pole pieces. The offset ribbon is located closer to the front of the microphone than the back of the microphone. The flux area is uniform and corresponds to the area of the air gap between the pole pieces.

BRIEF DESCRIPTION OF THE DRAWINGS

These and other attributes of the present invention will be described with respect to the following drawings in which:

FIG. 10 is a wiring diagram of the ribbon microphone according to the present invention;

FIGS. 11*a*–11*c* are side views of the ribbon microphone according to the present invention;

DETAILED DESCRIPTION OF THE INVENTION

Referring to FIGS. 1–5, a conventional ribbon microphone arrangement is illustrated. The conventional ribbon microphone 20, is shown in a top down view in FIG. 1, and has tapered poles 22*a* and 22*b*. The ribbon 24 is disposed between the north pole piece 22*a* and south pole piece 22*b*. The front of the microphone faces the top of FIG. 1.

Figure 1:
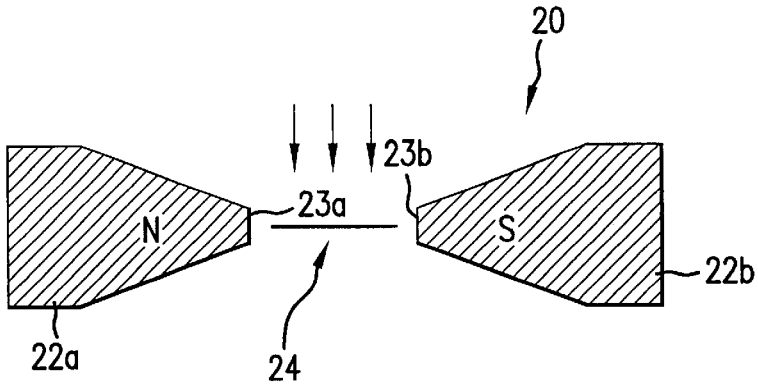
(PRIOR ART) FIG.1
FIG. 1 is a top down view of a conventional ribbon microphone with tapered poles.
Figure 2:
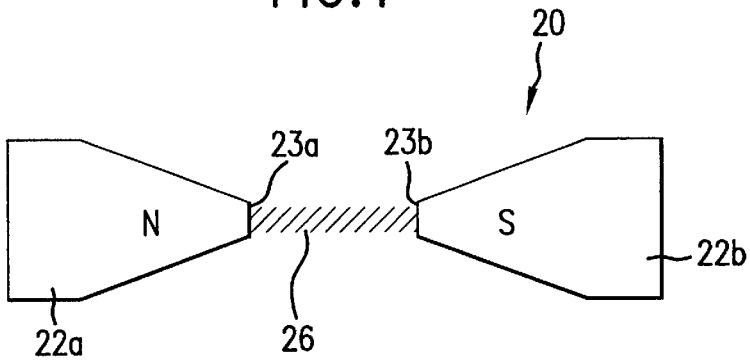
(PRIOR ART) FIG.2
FIG. 2 is a top down view of the conventional ribbon microphone shown in FIG. 1 showing the area of magnetic flux.

Referring to FIG. 2, the conventional ribbon microphone 20 of FIG. 1 is illustrated and shows the area of magnetic flux 26. The ribbon microphone 20 relies on the tapered pole-pieces 22*a* and 22*b* to concentrate the magnetic field to the narrow flux area 26, and to maximize the sensitivity of the microphone 20. The ribbon 24 is suspended exactly in the middle of that of the flux area 26. The pole pieces 22*a* and 22B have substantially flat pole faces 23*a* and 23*b*, and the faces 23*a* and 23*b* are parallel to one another and are spaced apart to provide and air gap 25, where the faces 23*a* and 23*b* define the ends of the air gap.

Figure 3:
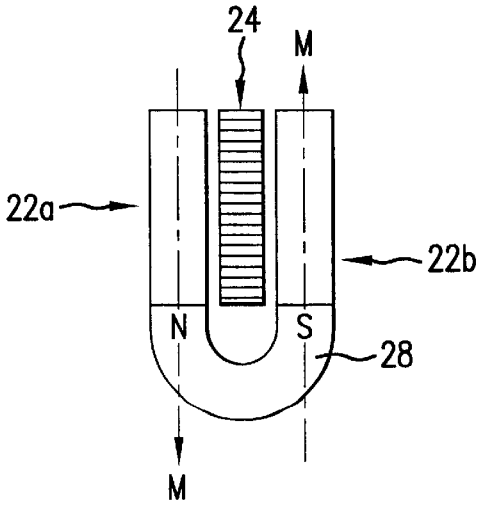
(PRIOR ART) FIG.3
FIGS. 3 and 4 are side views of the conventional ribbon microphone shown in FIG. 1.
Figure 4:
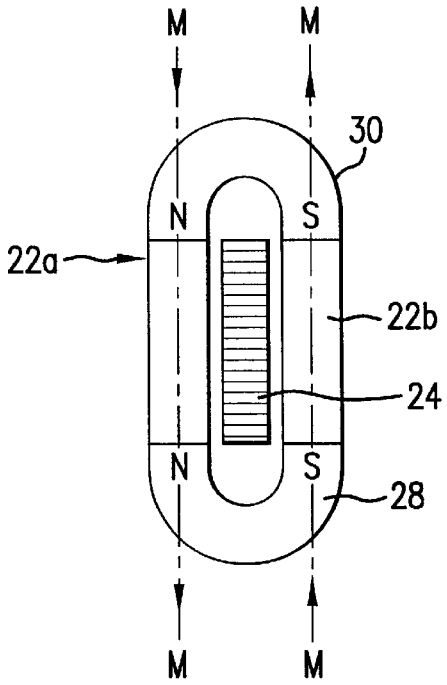
(PRIOR ART) FIG.4

Side views of the conventional ribbon microphone 20 are shown in FIGS. 3 and 4. FIG. 3 shows the ribbon 24 disposed between the tapered north pole piece 22*a* and the tapered south pole piece 22*b*. A lower horse shoe magnet 28 is positioned below the ribbon 24 and the pole pieces 22*a* and 22*b*. In FIG. 4 a second, upper horseshoe magnet 30 is disposed above the ribbon 24 and the pole pieces 22*a* and 22*b*. The horseshoe magnets 28 and 30 provide a suitable magnetic field.

In the conventional ribbon microphone 20 shown in FIGS. 3 and 4, the lines of magnetic flux from the magnets 28 and 30 are shown by lines M. These magnetic flux lines M are not perpendicular to the length of the ribbon 24. Rather, a substantial amount of the magnetic flux is wasted as stray radiation. The pole pieces 22*a* and 22*b* will redirect the lines of flux to some degree, but traditional designs still tend to be fairly inefficient due to stray radiation and losses in the pole pieces 22*a* and 22*b*.

Figure 5:
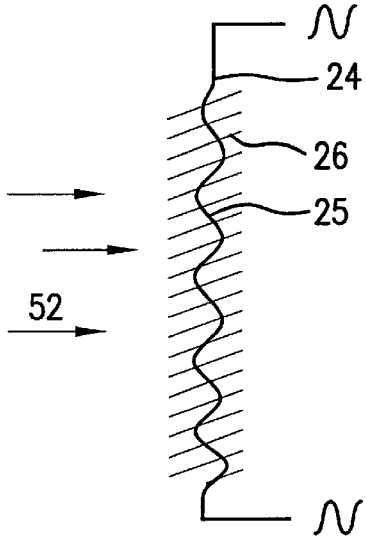
(PRIOR ART) FIG.5
FIG. 5 is a top view of a conventional ribbon microphone with a corrugated ribbon positioned within the flux area.

FIG. 5 shows a top view of a corrugated ribbon 24 positioned within the narrow flux area 26 of a conventional ribbon microphone 20. The corrugations 25 give the ribbon 24 more elasticity which results in greater movement and durability. However, due to the narrow flux area 26 of the conventional ribbon microphone 20, the corrugations will move outside the flux area 26, thereby reducing the output and producing high distortion.

Figure 6:
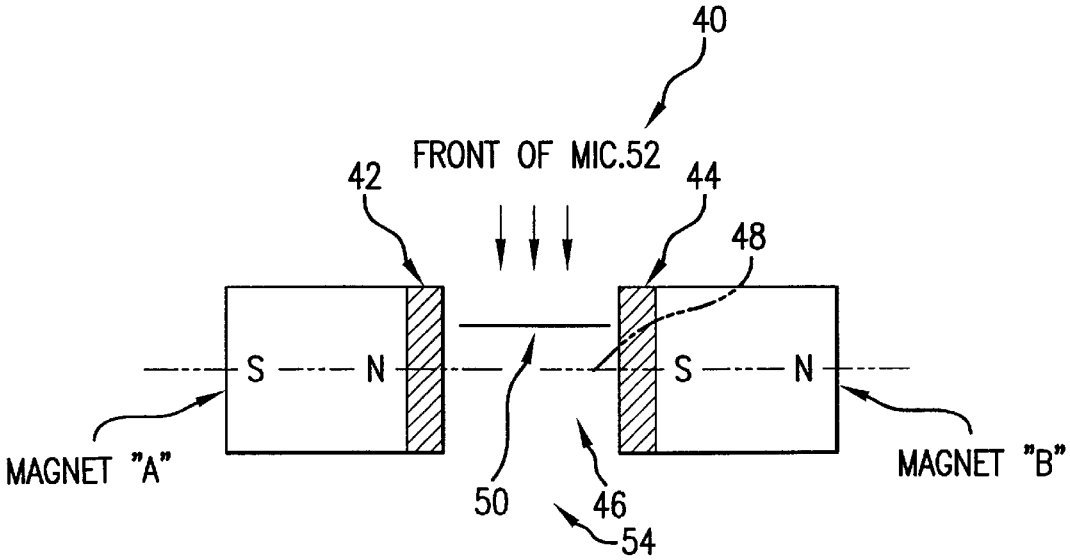
FIG. 6 is a top down view of the ribbon microphone according to the present invention.
Figure 7:
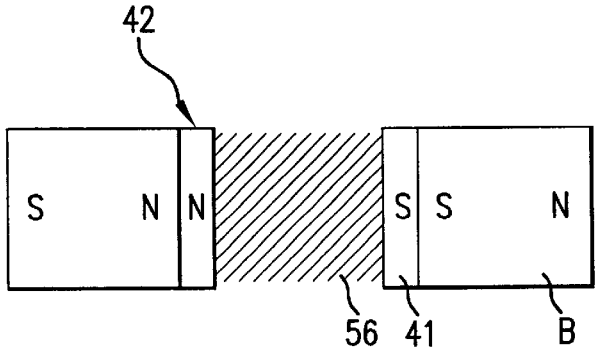
FIG. 7 is a top down view of the ribbon microphone according to the present invention, shown in FIG. 6 showing the area of magnetic flux.

The ribbon microphone 40 according to the present invention is illustrated in FIGS. 6–11. Top down views of ribbon microphone 40 are shown in FIGS. 6 and 7. The ribbon microphone 40 does away with traditional taper pole pieces, such as elements 22*a* and 22*b*, and utilizes a very wide configuration. Here a magnet A and a magnet B are positioned adjacent north pole piece 42 and south pole piece 44, respectively. The magnets A and B are of uniform thickness along their lengths, and do not taper. The pole pieces 42 and 44 are substantially the same width and the magnets A and B.

As shown in FIG. 6, the offset ribbon 50 is disposed in the air gap 46 between the pole pieces 42 and 44. Unlike the ribbon 24, shown in FIGS. 1–5, of traditional ribbon microphones, the offset ribbon 50 is not centered in the air gap 46. Rather, the offset ribbon is offset from a center line 48, which bisects the magnets A and B and pole pieces 42 and 44. The offset ribbon is located closer to the front 52 of the microphone 40 than the back of the microphone 54.

The flux area 56 is uniform and corresponds to the area of the air gap 46 between the pole pieces 42 and 44. By offsetting the offset ribbon 50 in the flux area 56 towards the front 52 of the microphone 40, even extremely loud sounds will not drive the offset ribbon 50 out of the air gap 46. Furthermore, even if the offset ribbon 50 becomes slightly bowed from abuse, the distortion will not increase, since the ribbon will still be disposed in the flux area 56. This results because any bowing of the offset ribbon 50 will be toward the center line 48 and away from the front of the microphone 52, since the sound waves will be originating from in front of the microphone 40. In addition, the degree of precision in assembly of the microphone is not as critical as it was for traditional microphones, since the ribbon is not positioned at the exact center of the tapered pole pieces, but instead is located offset toward the front 52 of the microphone 40. Thus, the ribbon microphone 40 according to the present invention is more tolerant.

Ribbon microphones in general possess certain acoustical characteristics that are ideal for use with modern digital recording techniques. However, as stated previously, the traditional ribbon microphones are incompatible with today's high volume levels. A ribbon microphone 40 according to the present invention will behave similar to a traditional ribbon microphone 20 at low and moderate volume levels. At very high levels, however, for the ribbon microphone 40 according to the present invention, instead of the offset ribbon 50 being driven out of the air gap, the offset ribbon 50 is actually driven further into the air gap 46, toward the center of the magnetic flux area 56. As a result, the harder the microphone 50 is driven, the more efficient the output will become.

Figure 8:
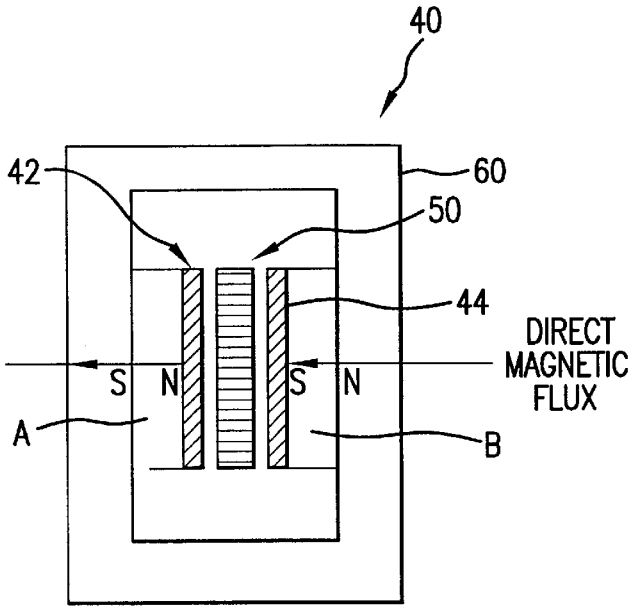
FIG. 8 is a side view of the ribbon microphone according to the present invention, shown in FIG. 6.

Referring now to FIG. 8, a side view of the ribbon microphone 50 according to the present invention is shown. The side view of FIG. 8 illustrates additional features of the present invention. A flux frame 60 is provided into which the magnets A and B and pole pieces 42 and 44 are mounted. The magnets A and B are extremely powerful, but small Neodymium Grade 44 magnets. The magnets A and B are actually in line with the offset ribbon 50. In other words, the length of the magnets A and B is equal with the length of the offset ribbon 50. As a result, the ribbon microphone 40 of the present invention produces a powerful magnetic field that is aligned for maximum density in the area where the offset ribbon 50 is located, and is termed a focused flux. The magnetic energy is not indirectly applied to the ribbon, as is the case with conventional ribbon microphones.

Figure 9:
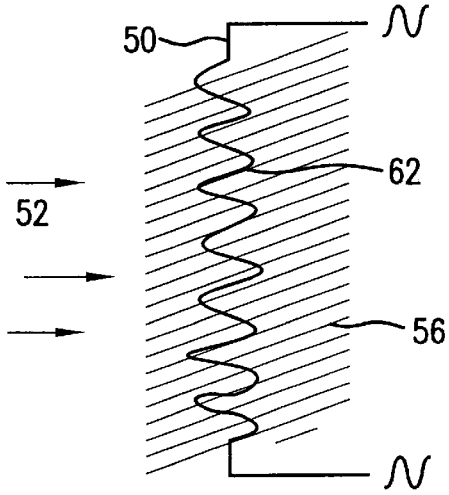
FIG. 9 is a top view of a ribbon microphone according to the present invention with the ribbon positioned within the flux area.

The offset ribbon 50 is made with 2.5 micron thick pure aluminum, and in the preferred embodiment is 3/16" wide by 1.5" long. While pure aluminum has been used in ribbon microphones, the incorporation of a thicker material with deeper corrugations has not. In addition, in a manner similar to the ribbon shown in FIG. 5, the offset ribbon 50 is corrugated as shown in FIG. 9. The corrugations 62 in the offset ribbon 50 are deeper than the corrugations 25 of the ribbon 24. The corrugations 62 provide a greater degree of elasticity which in turn provides greater movement and durability. The deeper corrugations 62 are only possible in the configuration of the present invention due to the wide flux area 56. In the conventional design, the deeper corrugations would extend out of the gap area and thereby produce high distortion and reduce the output.

FIG. 10 shows a wiring diagram of the ribbon microphone 40 of the present invention. The ribbon 50 is disposed between the magnets A and B and pole pieces 42 and 44, all of which is mounted with the flux frame. The low impedance output of the ribbon 50 is coupled to a highly efficient toroidal coupling transformer T-1 to a usable output (300 ohms) for a pre-amplifier. The transformer T-1 has turns ratios between 20:1 and 25:1. Traditional ribbon microphones use a "E&I" type transformer. The toroidal coupling transformer T-1 improves high frequency performance, minimizes magnetically induced noise and provides minimal transfer losses.

The incorporation of the microphone package as part of the magnetic circuit enables the entire microphone to be compact. FIGS. 11*a*–11*c* show side views of the ribbon microphone 40 of the present invention, and clearly represent the compact nature of the microphone.

Figure 12:
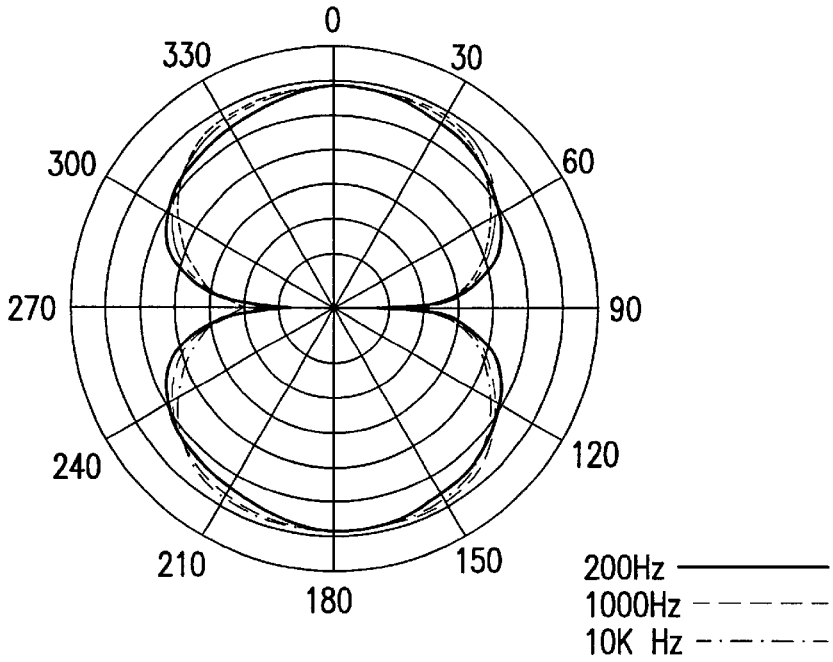
FIG. 12 is a chart of the polar pattern of the ribbon microphone according to the present.

The ribbon microphone 40 of the present invention provides a figure-8 polar pattern, as shown in FIG. 12, and thereby delivers superb ambience when used for room miking applications, orchestral and choral recordings. The ribbon microphone 40 has high sound pressure level (SPL) capabilities, requires no internal active electronics to overload or produce distortion up to the maximum SPL rating, and produces extremely low residual noise. Furthermore, the microphone 40 does not produce high frequency phase distortion, is equally sensitive from the front or back of the element, and provides consistent frequency response regardless of distance. The ribbon element 50 is not affected by humidity or temperature.

Figure 13:
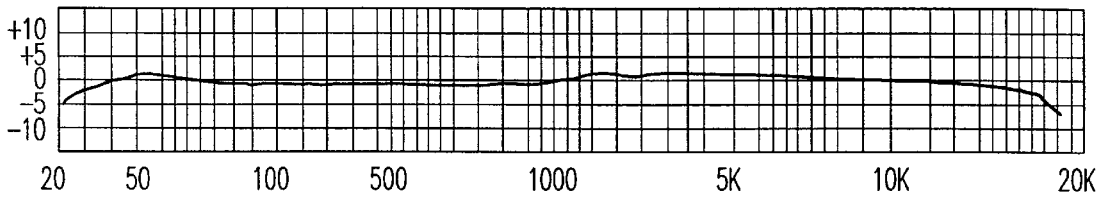
FIG. 13 is graph of the frequency response of the ribbon microphone according to the present invention.

The frequency response of the microphone 40 of the present invention is 30–15,000 Hz as shown in FIG. 13, and the sensitivity is −54 dBv Re. 1v/pa±1 dB. The output impedance is 300 Ohms @ 1K (nominal), 200 Ohms optional. The rated load impedance is greater than 1,000 Ohms. The Maximum SPL is greater than 130 dB.

Having described several embodiments of the ribbon microphone in accordance with the present invention, it is believed that other modifications, variations and changes will be suggested to those skilled in the art in view of the description set forth above. It is therefor to be understood that all such variations, modifications and changes are believed to fall within the scope of the invention as defined in the appended claims.

What is claimed is:

1. A ribbon microphone comprising:

a pair of magnets, spaced apart and parallel to one another;

a pair of pole pieces disposed adjacent said pair of magnets, said pole pieces being disposed in between said pair of magnets to define an air gap, said pair of magnets having uniform thickness along their lengths, and said pair of pole pieces being substantially the same width as the widths of said pair of magnets;

an aluminum offset ribbon disposed in said air gap between said pair of pole pieces, said offset ribbon being offset from a center line bisecting said pair of magnets and said pair of pole pieces such that said offset ribbon is located closer to a front said microphone than a back of said microphone, and said offset ribbon is approximately 2.5 micron thick, 3/16" wide and 1.5" long, wherein said microphone has a frequency response of 30–15,000 Hz, and a sensitivity of −54 dBv Re. 1v/pa±1 dB.

2. A ribbon microphone comprising:

a pair of magnets, spaced apart and parallel to one another;

a pair of pole pieces disposed adjacent said pair of magnets, said pole pieces being disposed in between said pair of magnets to define an air gap, said pair of magnets having uniform thickness along their lengths, and said pair of pole pieces being substantially the same width as the widths of said pair of magnets;

an aluminum offset ribbon disposed in said air gap between said pair of pole pieces, said offset ribbon being offset from a center line bisecting said pair of magnets and said pair of pole pieces such that said offset ribbon is located closer to a front said microphone than a back of said microphone, and wherein a low impedance output of said offset ribbon is coupled to a highly efficient toroidal coupling transformer to produce a usable output for a pre-amplifier, said transformer having turn ratios between 20:1 and 25:1; and wherein said microphone has a frequency response of 30–15,000 Hz and a sensitivity of −54 dBv Re. 1v/pa±1 dB.

3. A ribbon microphone as recited in claim 2, herein said pair of magnets and said pair of pole pieces provide a uniform flux area in said air gap.

4. A ribbon microphone as recited in claim 3, wherein said offset ribbon is driven towards said center line when subjected to large sound waves from in front of said front of said microphone, said offset ribbon remaining in said air gap.

5. A ribbon microphone as recited in claim 4, wherein said offset ribbon is driven further into a middle of said air gap, toward said center line of a magnetic flux area in said air gap such that when said microphone is driven harder, an output of said microphone becomes more efficient.

6. A ribbon microphone as recited in claim 2, further comprising a flux frame surrounding said pair of magnets.

7. A ribbon microphone as recited in claim 2, wherein said pair of magnets are powerful, small Neodymium Grade 44 magnets.

8. A ribbon microphone as recited in claim 2, wherein said pair of magnets are equal in length to said offset ribbon.

9. A ribbon microphone as recited in claim 8, wherein a powerful magnetic field is produced, said magnetic field being aligned for maximum density at said offset ribbon to produce a focused flux.

10. A ribbon microphone as recited in claim 2, wherein said offset ribbon is made of pure aluminum.

11. A ribbon microphone as recited in claim 10, wherein said offset ribbon is 2.5 micron thick, 3/16" wide and 1.5" long.

12. A ribbon microphone as recited in claim 2, wherein said offset ribbon is corrugated.

13. A ribbon microphone as recited in claim 2, wherein said microphone provides a figure-8 polar pattern.

14. A ribbon microphone comprising:

a pair of magnets, spaced apart and parallel to one another;

a pair of pole pieces disposed adjacent said pair of magnets, said pole pieces being disposed in between said pair of magnets to define an air gap, said pair of magnets having uniform thickness along their lengths, and said pair of pole pieces being substantially the same width and the widths of said pair of magnets;

an offset ribbon disposed in said air gap between said pair of pole pieces, said offset ribbon being offset from a center line bisecting said pair of magnets and said pair of pole pieces such that said offset ribbon is located closer to a front said microphone than a back of said microphone;

a flux frame surrounding said pair of magnets;

said pair of magnets and said pair of pole pieces providing a uniform flux area in said air gap;

said offset ribbon being driven towards said center line when subjected to large sound waves in front of said front of said microphone, said offset ribbon remaining in said air gap, and when said microphone is driven harder, an output of said microphone becomes more efficient, and wherein a low impedance output of said offset ribbon is coupled to a highly efficient toroidal coupling transformer to produce a usable output for a pre-amplifier, said transformer having turn ratios between 20:1 and 25:1; and wherein said microphone has a frequency response of 30–15,000 Hz and a sensitivity of −54 dBv Re. 1v/pa±1 dB.

15. A ribbon microphone as recited in claim 14, wherein said pair of magnets are powerful, small Neodymium Grade 44 magnets.

16. A ribbon microphone as recited in claim 14, wherein said pair of magnets are equal in length to said offset ribbon.

17. A ribbon microphone as recited in claim 16, wherein a powerful magnetic field is produced, said magnetic field being aligned for maximum density at said offset ribbon to produce a focused flux.

18. A ribbon microphone as recited in claim 14, wherein said offset ribbon is made of pure aluminum.

19. A ribbon microphone as recited in claim 18, wherein said offset ribbon is 2.5 micron thick, 3/16" wide and 1.5" long.

20. A ribbon microphone as recited in claim 14, wherein said microphone provides a figure-8 polar pattern.

* * * * *

UNITED STATES PATENT AND TRADEMARK OFFICE

CERTIFICATE OF CORRECTION

PATENT NO. : 6,434,252 B1
DATED : August 13, 2002
INVENTOR(S) : David E. Royer and Richard T. Perrotta It is certified that error appears in the above-identified patent and that said Letters Patent is hereby corrected as shown below:

Column 6,
Line 17, delete “herein” and insert -- “wherein” -- therefore.

Signed and Sealed this

Third Day of June, 2003

JAMES E. ROGAN
*Director of the United States Patent and Trademark Office*